US011892191B2

(12) United States Patent
Meng et al.

(10) Patent No.: US 11,892,191 B2
(45) Date of Patent: Feb. 6, 2024

(54) AIR OUTLET STRUCTURE AND AIR CONDITIONER HAVING SAME

(71) Applicant: GREE ELECTRIC APPLIANCES, INC. OF ZHUHAI, Guangdong (CN)

(72) Inventors: Zhi Meng, Zhuhai (CN); Zhongliang Zhou, Zhuhai (CN); Qiangyan Ning, Zhuhai (CN); Jun Chen, Zhuhai (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 619 days.

(21) Appl. No.: 17/052,058

(22) PCT Filed: Dec. 3, 2018

(86) PCT No.: PCT/CN2018/118959

§ 371 (c)(1),
(2) Date: Oct. 30, 2020

(87) PCT Pub. No.: WO2019/214220

PCT Pub. Date: Nov. 14, 2019

(65) Prior Publication Data

US 2021/0140676 A1 May 13, 2021

(30) Foreign Application Priority Data

May 7, 2018 (CN) ..... 201810427297.8

(51) Int. Cl.
*F24F 13/14* (2006.01)
*F24F 1/0003* (2019.01)
*F24F 13/22* (2006.01)

(52) U.S. Cl.
CPC ..... *F24F 13/1413* (2013.01); *F24F 1/0003* (2013.01); *F24F 13/222* (2013.01); *F24F 2013/221* (2013.01)

(58) Field of Classification Search
CPC .... F24F 13/1413; F24F 1/0057; F24F 1/0011; F24F 1/0003
See application file for complete search history.

(56) References Cited

U.S. PATENT DOCUMENTS 5,547,018 A 8/1996 Takahashi et al.
5,868,313 A * 2/1999 Weng ..... F24F 13/06 454/302

(Continued)

FOREIGN PATENT DOCUMENTS

CN 201615577 U 10/2010
CN 102213481 A 10/2011

(Continued)

OTHER PUBLICATIONS

International Search Report for Application No. PCT/CN2018/118959 dated Mar. 5, 2019 (6 pages).

(Continued)

*Primary Examiner* — Filip Zec
(74) *Attorney, Agent, or Firm* — J. Miguel Hernandez; James R. Gourley; Carstens, Allen & Gourley, LLP

(57) ABSTRACT

An air outlet structure, including: an air outlet portion body having an air outlet, an air deflector support connected to the air outlet portion body and disposed at a lower portion of the air outlet, and an air deflector rotatably provided on the air deflector support. Also provided is an air conditioner having the air outlet structure. The air outlet structure solves a problem that the air deflector of the air outlet structure in prior art is not easily opened or closed.

19 Claims, 3 Drawing Sheets

(56) References Cited

U.S. PATENT DOCUMENTS

| | | | | |
|---|---|---|---|---|
| 5,924,923 | A * | 7/1999 | Chiguchi | F24F 1/0011 165/122 |
| 6,083,101 | A * | 7/2000 | Kaga | F24F 1/0057 165/122 |
| 6,276,440 | B1 * | 8/2001 | Kaga | F24F 13/04 165/122 |
| 9,513,020 | B2 * | 12/2016 | Ikeda | F24F 1/0011 |
| 9,829,211 | B2 * | 11/2017 | Zhang | F24F 13/1426 |
| 10,180,285 | B2 * | 1/2019 | Josserand | F28D 7/0058 |
| 10,190,798 | B2 * | 1/2019 | Zheng | F24F 13/1486 |
| 10,422,549 | B2 * | 9/2019 | Luo | F24F 13/1426 |
| 10,895,388 | B2 * | 1/2021 | Shirota | F24F 1/0057 |
| 11,054,151 | B2 * | 7/2021 | Bai | F24F 1/0025 |
| 11,161,393 | B2 * | 11/2021 | Demerath | B60H 1/3421 |
| 2020/0018515 | A1 * | 1/2020 | Awasthi | F24F 13/072 |
| 2021/0215380 | A1 * | 7/2021 | Cai | F24F 1/0011 |

FOREIGN PATENT DOCUMENTS

| | | | | |
|---|---|---|---|---|
| CN | 105910173 | A | 8/2016 | |
| CN | 106440292 | A | 2/2017 | |
| CN | 107131564 | A | 9/2017 | |
| CN | 107166528 | A | 9/2017 | |
| CN | 108489064 | A | 9/2018 | |
| CN | 208238179 | U | 12/2018 | |
| EP | 2455679 | A1 | 5/2012 | |
| EP | 2813777 | A1 | 12/2014 | |
| EP | 2821717 | A1 * | 1/2015 | F24F 1/0011 |
| EP | 2821717 | A1 | 1/2015 | |

OTHER PUBLICATIONS

Extended European Search Report for European Application No. 18917904.7 dated May 3, 2021 (8 pages).

* cited by examiner

AIR OUTLET STRUCTURE AND AIR CONDITIONER HAVING SAME

CROSS REFERENCE TO RELATED APPLICATIONS

This application claims all benefits accruing under 35 U.S.C. § 119 from China Patent Application No. 201810427297.8, filed on May 7, 2018 in the China National Intellectual Property Administration, the entire content of which is hereby incorporated by reference. This application is a national phase under 35 U.S.C. § 120 of international patent application PCT/CN2018/118959, entitled "AIR OUTLET STRUCTURE AND AIR CONDITIONER HAVING SAME" filed on Dec. 3, 2018, published as WO 2019/214220 on Nov. 14, 2019. Every patent application and publication listed in this paragraph is hereby incorporated by reference in its entirety.

TECHNICAL FIELD

The present disclosure relates to the field of air conditioner, and particularly, to an air outlet structure and an air conditioner having the same.

BACKGROUND

In an existing indoor unit of an air conditioner of a double-air deflector-fully enclosed type, the air deflectors are provided on a panel body through an air deflector support. The air deflectors rotate relative to the air deflector support to achieve air swing at an air outlet. The existing air deflector supports are all provided at a middle position of the air outlet. When the air deflector rotates, due to a position limitation of s the air deflector support, a rotation direction of the air deflector is affected, and opening and closing of the air deflector is directly affected.

In addition, during an operation of a refrigeration mode of the indoor unit of the air conditioner, in order to achieve comfort of the air conditioner, air temperature at the air outlet is relatively low, and ambient humidity is relatively large. In this case, condensation water is easily formed on a leeward side of a lower air deflector support, i.e., on a lower side surface and a front end surface of the support, and water start to drop continuously 2 to 3 hours after the air conditioner turns on, which may cause damage to floor or other objects in a user's house and affect quality of the air conditioner.

SUMMARY

The present disclosure is related to an air outlet structure and an air conditioner having the same to solve a problem that the air deflector of the air outlet structure known to the inventors is not easily opened or closed.

According to one aspect of the present disclosure, an air outlet structure is provided, and the air outlet structure includes: an air outlet portion body having an air outlet; an air deflector support connected to the air outlet portion body and provided at a lower portion of the air outlet; and an air deflector rotatably provided on the air deflector support.

Further, the air outlet portion body is provided with a flow guiding channel; the flow guiding channel is in communication with the air outlet; and the air deflector support is connected to a channel wall of the flow guiding channel.

Further, the flow guiding channel is a groove.

Further, a cross section of the flow guiding channel is trapezoidal, and the flow guiding channel gradually shrinks in a flow direction of an air current.

Further, a second preset included angle b is formed between two adjacent side walls of the flow guiding channel, and $15° \leq b \leq 85°$ is satisfied.

Further, the air deflector support includes: a support body connected to the air deflector, and a flow guiding portion provided on the support body; the flow guiding portion includes at least one of a convex portion or a concave portion.

Further, the flow guiding portion is provided on a lower edge of the support body.

Further, there are a plurality of flow guiding portions, and the plurality of flow guiding portions are provided at intervals along an outer edge of the support body.

Further, the flow guiding portion is a groove, and a cross-section of the groove is trapezoidal.

Further, the flow guiding portion includes a bottom wall, a first side wall, and a second side wall; the bottom wall is disposed between the first side wall and the second side wall; and a first curved transition is formed between the bottom wall and the first side wall, and/or, a second curved transition is formed between the bottom wall and the second side wall.

Further, a first preset included angle $\alpha$ is formed between a plane where the bottom wall is located and a horizontal plane, and the first preset included angle $\alpha$ is an acute angle.

Further, $0 \leq a \leq 15.5°$.

Further, the support body includes: a first outer edge, and a second outer edge joined to the first outer edge; in a flow direction of an air current, the air current passes through the first outer edge and the second outer edge in sequence; and at least a part of the second outer edge is provided with the flow guiding portion.

Further, the support body further includes a third outer edge connected to the second outer edge; the second outer edge is located between the first outer edge and the third outer edge; and the third outer edge is provided with the flow guiding portion.

Further, the third outer edge is inclined downwards relative to the first outer edge.

Further, the air outlet portion body includes a bottom shell and a panel body; and the air deflector support is provided on the panel body or on the bottom shell.

Further, the air outlet structure further includes an upper air deflector support connected to the air outlet portion body and provided on an upper portion of the air outlet, and an upper air deflector rotatably provided on the upper air deflector support.

Further, the air deflector has a first position and a second position, and the upper air deflector has a third position and a fourth position; when the air deflector is located at the first position, and when the upper air deflector is located at the third position, the air deflector and the upper air deflector are configured to block the air outlet; and when the air deflector is located at the second position, and when the upper air deflector is located at the fourth position, the air deflector and the upper air deflector are configured enable the air outlet to be exposed.

Further, the air deflector is configured to move from the first position to the second position in a first direction; the upper air deflector is configured to move from the third position to the fourth position in a second direction; and the first direction is a clockwise direction, and the second direction is a counterclockwise direction; or the first direction is a counterclockwise direction, and the second direction is a clockwise direction.

According to another aspect of the present disclosure, an air conditioner is provided and includes an air outlet structure, and the air outlet structure is any one of the air outlet structures above.

In the air outlet structure of the present disclosure, the air deflector support is provided at the lower portion of the air outlet, and the air deflector is rotatably provided on the air deflector support, thereby facilitating the opening and closing of the air deflector; and during the opening and closing of the air deflector, the problem of interference does not occur. The air outlet portion body has an air outlet, and the air deflector support is connected to the air outlet portion body. In the air outlet structure of the present disclosure, the air deflector support is provided at the lower portion of the air outlet, so that the problem of interference does not occur during the opening or closing of the air deflector, thereby solving the problem of the air outlet structure known to the inventors that the air deflector is not easily opened or closed.

BRIEF DESCRIPTION OF THE DRAWINGS

The accompanying drawings constituting a part of the present disclosure are provided to further make the present disclosure understood. The illustrative embodiments of the present disclosure and the description are used to explain the present disclosure, but not intended to limit the present disclosure. In the drawings.

DETAILED DESCRIPTION OF THE EMBODIMENTS

Figure 1:
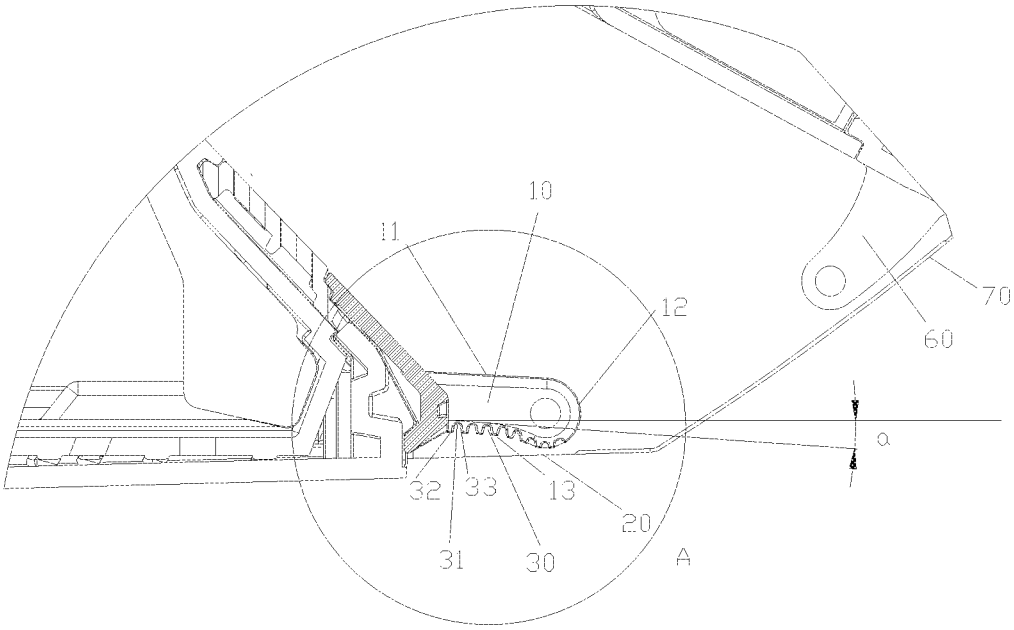
FIG. 1 shows a schematic view of a local structure of an air outlet structure from a first visual angle according to the present disclosure.

It should be specified that, the embodiments and the features in the embodiments of the present disclosure may be combined with each other if there is no conflict. The embodiments of present disclosure will be described in detail with reference to the accompanying drawings.

It should be noted that the following detailed description is illustrative and intended to provide further explanations of the present disclosure. Unless otherwise specified, all technical and scientific terms in the present disclosure have the same meaning as commonly understood by those ordinary skilled in the art of the present disclosure.

It should be noted that, the terminology herein is used for describing the specific embodiments, but not intended to limit the illustrative embodiments of the present disclosure. The singular terms herein are intended to include their plural unless specific descriptions are provided in context. Additionally, it should be also understood that, the terms "include" and/or "comprise" in the description refer to including the features, steps, operations, devices, components, and/or combinations thereof.

The present disclosure provides an air outlet structure. Referring to FIG. 1 to FIG. 4, the air outlet structure includes: an air outlet portion body having an air outlet 40, an air deflector support connected to the air outlet portion body and provided at a lower portion of the air outlet 40, and an air deflector 20 rotatably provided on the air deflector support.

As for the air outlet structure of the present disclosure, the air deflector support is provided at the lower portion of the air outlet 40, and the air deflector 20 is rotatably provided on the air deflector support, thereby facilitating opening and closing of the air deflector 20. In a process of opening and closing the air deflector 20, a problem of interference does not occur. The air outlet portion body has an air outlet 40, and the air deflector support is connected to the air outlet portion body. In the air outlet structure of the present disclosure, the air deflector support is provided with at the lower portion of the air outlet 40, so that the problem of interference does not occur in the process of opening or closing the air deflector 20, thereby solving the problem of the air outlet structure known to the inventors that the air deflector is not easily opened or closed.

In some embodiments, the air deflector 20 is a lower air deflector of the air outlet structure.

In some embodiments, optionally, the air deflector support is provided at the lower portion of the air outlet 40, that is, the air deflector support is located at a position inside the air outlet 40 and adjacent to a lower edge of the air outlet 40, which means that the air deflector support is relatively close to the outside space.

In some embodiments, optionally, the air deflector support is provided at the lower portion of the air outlet 40, that is, the air deflector support is located at a position outside the air outlet 40 and adjacent to the lower edge of the air outlet 40.

Figure 3:
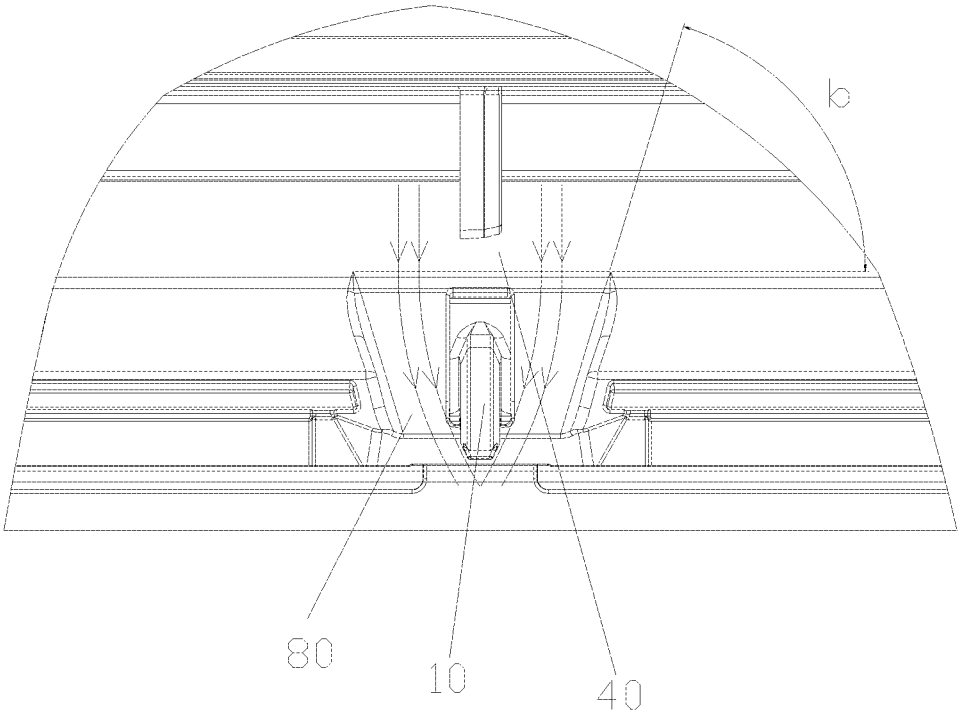
FIG. 3 shows a schematic view of a local structure of the air outlet structure from a second visual angle according to the present disclosure.

Considering that condensation water is easily formed on the lower portion of the air deflector support when the air deflector support is provided at the lower portion of the air outlet 40, as shown in FIG. 3, the air outlet portion body is provided with a flow guiding channel 80, which is in communication with the air outlet 40, and the air deflector support is connected to a channel wall of the flow guiding channel 80.

In these embodiments, the air outlet portion body is provided with the flow guiding channel 80; the flow guiding channel 80 is in communication with the air outlet 40; and the air deflector support is connected to the channel wall of the flow guiding channel 80. During a flow of an air current, due to the existence of the flow guiding channel 80, the air current is guided to blow onto the air deflector support through the flow guiding channel 80, thus a temperature difference between the air deflector support and the outside environment is reduced, and the generation of condensation water is prevented.

In some embodiments, the flow guiding channel 80 is provided inside the air outlet 40.

In some embodiments, the flow guiding channel 80 is a groove.

Regarding a specific structure of the flow guiding channel 80, a cross section of the flow guiding channel 80 is trapezoidal, and the flow guiding channel 80 gradually shrinks in a flow direction of the air current.

In some embodiments, a second preset included angle b is formed between two adjacent side walls of the flow guiding channel 80, where $15° \leq b \leq 85°$.

Optionally, $40° \leq b \leq 85°$.

In some embodiments, $60° \leq b \leq 80°$.

In some embodiments, the flow guiding channel 80 is an inverted "A"-shaped air guide groove, and the air deflector support is provided at a middle position of the flow guiding channel 80.

A bevel edge of the inverted-"八"-shaped air guide groove forms an angle of about 10° to 30° relative to a vertical position of a lower edge of the air outlet. A width of a lower end of the groove ranges from 8 mm to 15 mm, and a depth of the groove ranges from 1 mm to 3 mm. The structure of the inverted-"八"-shaped air guide groove enables cold air blowing out along a lower surface of an air duct to blow to a lower end surface of the air deflector support, therefore ability of isolating indoor hot air from the lower end surface of the air deflector support is improved, and the problem that the condensation water is easily formed on the support is comprehensively solved.

Figure 2:
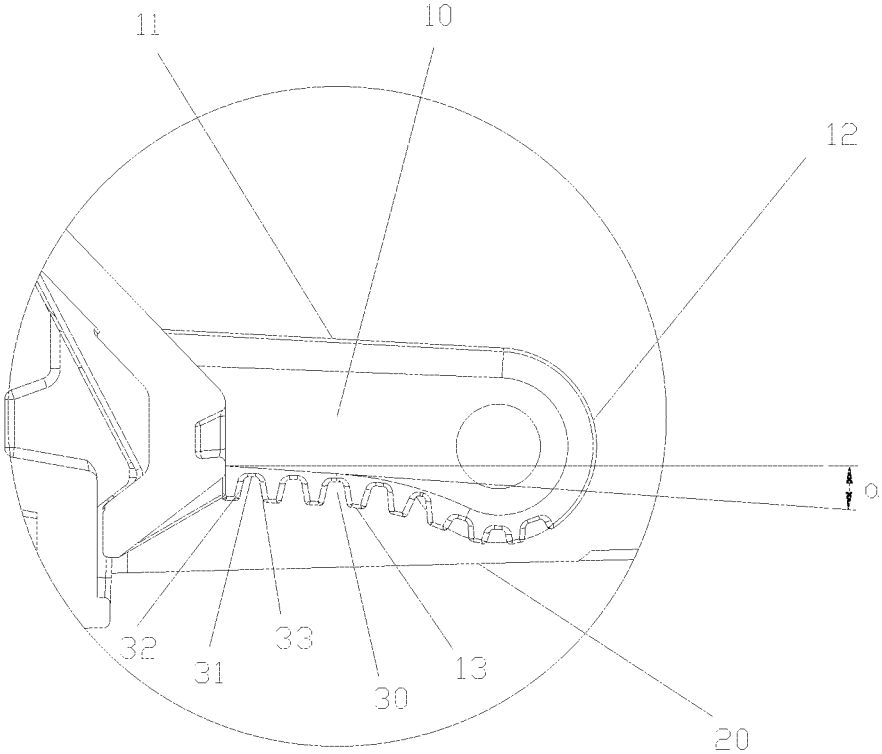
FIG. 2 shows an enlarged schematic view of a local structure at a position A of the air outlet structure in FIG. 1.

Regarding the specific structure of the air deflector support, as shown in FIGS. 1 and 2, the air deflector support includes: a support body 10 connected to the air deflector 20, and a flow guiding portion 30 provided on the support body 10. The flow guiding portion 30 comprises at least one of a convex portion or a concave portion.

In these embodiments, the support body 10 is provided with the flow guiding portion 30, which can increases an adhesion area of the condensation water, thereby preventing a large amount of condensation water from falling. The support body 10 is configured to be connected to the air deflector 20, and the flow guiding portion 30 is at least one of the convex portion or the concave portion.

In these embodiments, the support body 10 is provided with the flow guiding portion 30, which increases the adhesion area of the condensation water, prevent condensation water from gathering greatly, and reduce an amount of the fallen condensation water, thereby solving the problem that the condensation water generated by the air deflector support known to the inventors falls easily.

Considering that all condensation water is concentrated on an outer edge of the support body 10, the flow guiding portion 30 is provided on the outer edge of the support body 10.

Considering that the condensation water is mostly formed on a lower edge of the support body 10, the flow guiding portion 30 is provided on the lower edge of the support body 10.

In order to increase a guiding area, there are a plurality of flow guiding portions 30, and the plurality of flow guiding portions 30 are provided at intervals along the outer edge of the support body 10.

In some embodiments, considering that a large amount of condensation water is formed on one side of the support body 10 adjacent to the air outlet, the plurality of flow guiding portions 30 are provided at intervals on a part of the outer edge of the support body 10.

In these embodiments, the flow guiding portion 30 is provided on the outer edge of the support body 10. There are a plurality of flow guiding portions 30; the plurality of flow guiding portions 30 are provided at intervals along the outer edge of the support body 10; and the part of the outer edge of the support body 10 are provided with the plurality of flow guiding portions 30 at intervals. Accordingly, in some embodiments the guiding area is increased without excessively increasing additional structures for the support body, but only the flow guiding portion 30 is needed to be provided at a position where condensation water is formed.

Regarding the specific structure of the flow guiding portion 30, the flow guiding portion 30 is a groove, and the groove is a rectangular groove or a V-shaped groove.

In these embodiments, the flow guiding portion 30 is the groove, that is, the groove is provided on the outer edge surface of the support body 10.

Optionally, the groove is the rectangular groove or the V-shaped groove.

Regarding a specific structure of the flow guiding portion 30, the flow guiding portion 30 is a groove, and a cross section of the groove is trapezoidal.

Regarding the specific composition of the flow guiding portion 30, as shown in FIGS. 1 and 2, the flow guiding portion 30 includes a bottom wall 31, a first side wall 32, and a second side wall 33. The bottom wall 31 is disposed between the first side wall 32 and the second side wall 33. A first curved transition is formed between the bottom wall 31 and the first side wall 32, and/or, a second curved transition is formed between the bottom wall 31 and the second side wall 33.

In these embodiments, the cross section of the flow guiding portion 30 is trapezoidal, that is, the flow guiding portion 30 is a trapezoidal groove. The flow guiding portion 30 includes the bottom wall 31, the first side wall 32, and the second side wall 33. The bottom wall 31 is disposed between the first side wall 32 and the second side wall 33. The bottom wall 31, the first side wall 32, and the second side wall 33 are three groove surfaces of the trapezoidal groove.

By configuring the first curved transition formed between the bottom wall 31 and the first side wall 32, and/or the second curved transition between the bottom wall 31 and the second side wall 33, the condensation water earl boil prevented from gathering at a certain position and falling down.

In some embodiments, a first preset included angle $\alpha$ is formed between a plane where the bottom wall 31 is located and a horizontal plane, and the first preset included angle $\alpha$ is an acute angle.

In these embodiments, the first preset included angle $\alpha$ is formed between the plane where the bottom wall 31 is located and the horizontal plane, where the horizontal plane is defined relative to an installation position of the air deflector support. That is, when the air deflector support is installed in position, the bottom wall 31 has a certain inclination relative to the horizontal plane, and a configuration of the inclination also makes the adhesion area of the condensation water to be increased.

Optionally, $0 \leq a \leq 15.5°$.

Optionally, $1.5° \leq a \leq 15.5°$.

In some embodiments, $3° \leq a \leq 12°$.

Regarding the specific structure of the support body 10, as shown in FIGS. 1 and 2, the support body 10 includes a first outer edge 11 and a second outer edge 12. The second outer edge 12 is joined to the first outer edge 11. In the flow direction of the air current, the air current passes through the first outer edge 11 and the second outer edge 12 in sequence. At least a part of the second outer edge 12 is provided with the flow guiding portion 30.

In these embodiments, the support body 10 includes the first outer edge 11 and the second outer edge 12. The second outer edge 12 is joined to the first outer edge 11. In the flow direction of the air current, the air current passes through the first outer edge 11 and the second outer edge 12 in sequence, that is, the second outer edge 12 is closer to the outside space, and the condensation water is easily formed thereon. Therefore at least the part of the second outer edge 12 is provided with the flow guiding portion 30 to prevent the condensation water from gathering.

Correspondingly, the support body 10 further includes a third outer edge 13 joined to the second outer edge 12. The second outer edge 12 is located between the first outer edge 11 and the third outer edge 13. The third outer edge 13 is provided with the flow guiding portion 30.

In these embodiments, the support body 10 includes the first outer edge 11 and the second outer edge 12. The second outer edge 12 is joined to the first outer edge 11. In the flow direction of the air current, the air current passes through the first outer edge 11 and the second outer edge 12 in sequence, that is, the second outer edge 12 is closer to the outside space, and the condensation water is easily formed thereon. Therefore at least the part of the second outer edge 12 is provided with the flow guiding portion 30 to prevent the condensation water from gathering.

Correspondingly, the support body 10 further includes a third outer edge 13 joined to the second outer edge 12. The second outer edge 12 is located between the first outer edge 11 and the third outer edge 13. The third outer edge 13 is provided with the flow guiding portion 30.

In these embodiments, the third outer edge 13 is located in the lower portion of the support body 10, that is, compared with the first outer edge 11, the third outer edge 13 is closer to the lower edge of the air outlet 40 and closer to the outside space.

In these embodiments, the support body 10 includes the first outer edge 11, the second outer edge 12, and the third outer edge 13. The second outer edge 12 is located between the first outer edge 11 and the third outer edge 13. In the flow direction of the air current, the air current passes through the first outer edge 11, the second outer edge 12, and the third outer edge 13 in sequence. That is, compared with the second outer edge 12, the third outer edge 13 is closer to the outside space, and the air current finally blows to the third outer edge 13, or the air current is unable to directly blow to the third outer edge 13. Therefore, by providing the flow guiding portion 30 on the third outer edge 13, the adhesion area of the condensation water on the third outer edge 13 is increased.

In some embodiments, optionally, the air current can blows to the third outer edge 13 through the second outer edge 12.

In some embodiments, the third outer edge 13 is curved surface, and a curved transition is formed between the second outer edge 12 and the third outer edge 13.

In some embodiments, the third outer edge 13 is inclined downwards relative to the first outer edge 11.

In some embodiments, the first outer edge 11 is a flat surface, and the second outer edge 12 is a circular-arc-shaped surface.

In some embodiments, the third outer edge 13 is a curved surface.

In some embodiments, the lower surface or the front end surface of the support body 10 is provided with the flow guiding portion 30. The flow guiding portion 30 has a tooth-shaped groove structure such as rectangular tooth, V-shaped tooth, concave and convex groove/dot, sunned print, and a grid-shaped tooth, etc. A width of the tooth ranges from 1 mm to 2 mm, and a height of the tooth ranges from 1 mm to 2 mm.

In some embodiments, by configuring the flow guiding portion 30 with a tooth-shaped groove surface, on one hand, some condensation water is collected in the tooth-shaped groove, which increases the water collection or water storage capacity of the lower surface. On the other hand, an area of the lower surface of the support body 10 is increased, thereby increasing the adhesion area of the condensation water. Even if some condensation water is generated on the lower surface of the support, the condensation water delays falling.

Figure 4:
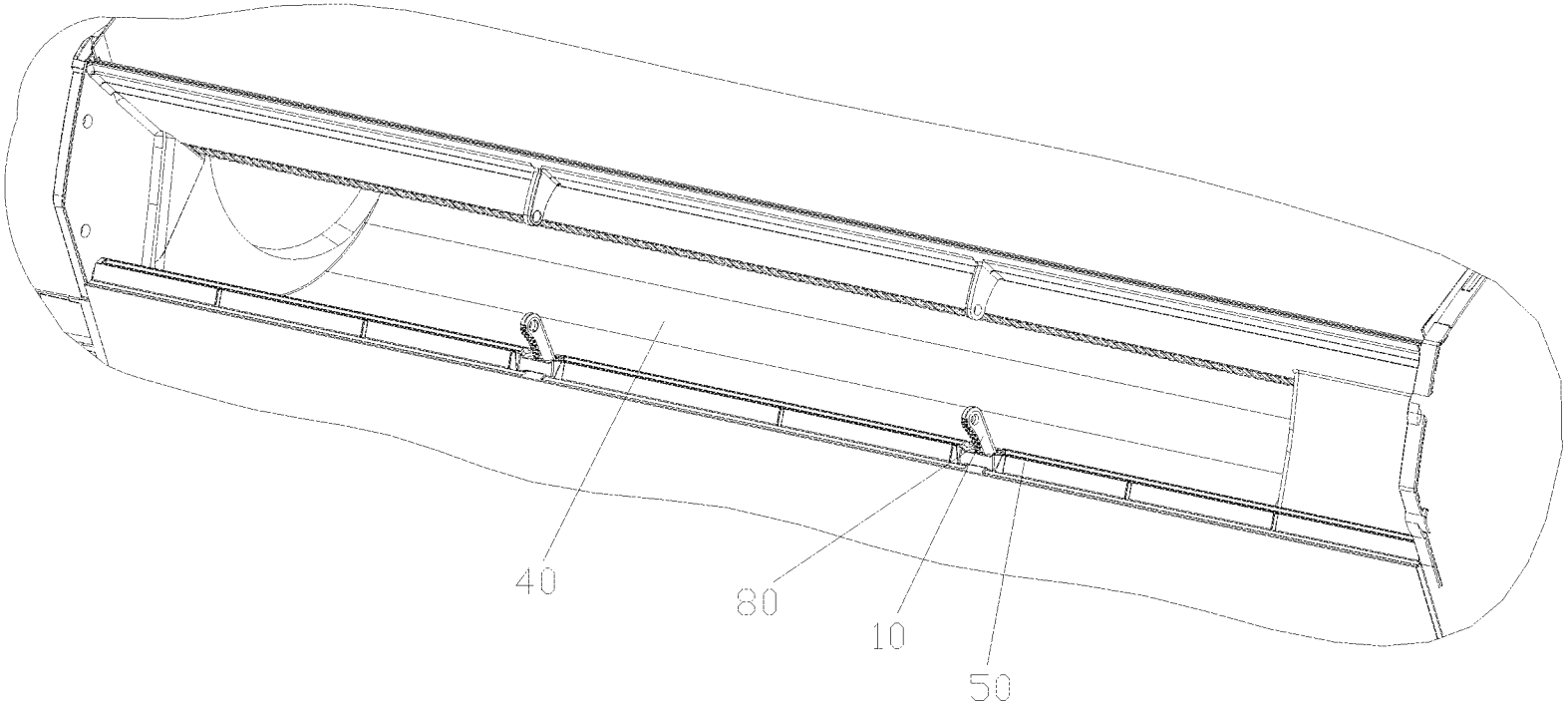
FIG. 4 shows a structural schematic diagram of some embodiments of the air outlet structure according to the present disclosure.

Regarding the specific structure of the air outlet portion body, as shown in FIG. 4, the air outlet portion body includes a bottom shell and a panel body 50. The air deflector support is provided on the panel body 50 or the bottom shell.

In some embodiments, the air outlet portion body includes a bottom shell and a panel body 50, and the bottom shell and the panel body 50 are connected.

In some embodiments, optionally, the air deflector support is provided on the panel body 50.

Optionally, the air deflector support is provided on the bottom shell.

In some embodiments, the air deflector support is disposed on the bottom shell or on the panel body 50 at the lower edge of the air outlet, and an extended length of the air deflector support is determined according to an actually required width, appearance, and strength of the lower air deflector. The width of the support ranges from about 3 mm to 6 mm, and the height ranges from about 4 mm to 10 mm. Edges of corners around are rounded or chamfered. Making advantages of a sideward effect, cold air blowing out from the air duct blows to the lower end surface of the air deflector support along two side surfaces of the support as much as possible, so as to isolate the indoor hot air from the surface of the air deflector support, thereby avoiding generation of the condensation water.

Considering the structural integrity of the air outlet structure, as shown in FIG. 1, the air outlet structure further includes an upper air deflector support 60 connected to the air outlet portion body and provided at an upper portion of the air outlet 40, and an upper air deflector 70 rotatably provided on the upper air deflector support 60.

In these embodiments, the air outlet structure further includes the upper air deflector support 60 and the upper air deflector 70. The upper air deflector support 60 and the air outlet portion body are connected. The upper air deflector support 60 is provided at the upper portion of the air outlet 40. The upper air deflector 70 is rotatably provided on the upper air deflector support 60.

In some embodiments, the air deflector 20 is a lower air deflector. The upper air deflector support 60 and the lower air deflector form an entire air guide structure.

Regarding specific operation modes of the upper air deflector support 60 and the lower air deflector, the air deflector 20 has a first position and a second position, and the upper air deflector 70 has a third position and a fourth position. When the air deflector 20 is located at the first position, and when the upper air deflector 70 is located at the third position, the air deflector 20 and the upper air deflector 70 are configured to block the air outlet 40. When the air deflector 20 is located at the second position, and when the upper air deflector 70 is located at the fourth position, the air deflector 20 and the upper air deflector 70 are configured to enable the air outlet 40 to be exposed.

In some embodiments, the air deflector 20 moves from the first position to the second position in a first direction, and the upper air deflector 70 moves from the third position to the fourth position in a second direction. The first direction is a clockwise direction, and the second direction is a counterclockwise direction. Alternatively, the first direction is a counterclockwise direction, and the second direction is a clockwise direction.

In some embodiments, the upper air deflector support 60 and the lower air deflector of the air outlet structure form a fully sealed air deflector structure. Since the air deflector support is provided at the lower portion of the air outlet 40, that is, the lower air deflector support is provided at the lower portion of the air outlet 40, even if the air outlet 40 is opened in two opposite directions therebetween, interference phenomenon does not occur. Therefore, there is no need to leave a certain clearance between the air deflector and the panel. Accordingly, in some embodiments, on the basis of ensuring that the air outlet 40 is completely sealed, the opening and closing of the air outlet 40 is conveniently achieved.

The present disclosure further provides an air conditioner including an air outlet structure, and the air outlet structure is the aforementioned air outlet structure.

From the above description, it can be seen that the above-mentioned embodiments of the present disclosure achieve the following technical effects.

In the air outlet structure of the present disclosure, the air deflector support is provided at the lower portion of the air outlet 40, and the air deflector 20 is rotatably provided on the air deflector support, thereby facilitating the opening and closing of the air deflector 20; and during the opening and closing of the air deflector 20, the problem of interference does not occur. The air outlet portion body has an air outlet 40, and the air deflector support is connected to the air outlet portion body. In the air outlet structure of the present disclosure, the air deflector support is provided at the lower portion of the air outlet 40, so that the problem of interference does not occur during the opening or closing of the air deflector 20, thereby solving the problem of the air outlet structure known to the inventors that the air deflector is not easily opened or closed.

It should be specified that the terms "first", "second", etc. in the description, the claims and the drawings in the present disclosure are just used to distinguish similar objects, but not used to describe a specific order or an order of priority. It should be understood that such terms may be interchangeable under appropriate conditions, such that the embodiments of the present disclosure illustrated in the drawing or described herein can bcis implemented, for example, in a sequence other than the sequences illustrated or described herein. In addition, the terms "comprise", "have" and any variations thereof are intended to cover a non-exclusive inclusion. For example, a process, a method, a system, a product, or a device that includes a series of steps or units is not limited to those steps or units listed clearly, but may include other steps or units, which are not clearly listed, or which are inherent to such a process, a method, a product or a device.

For the convenience of description, terms of spatial relations such as "above", "over", "on a top surface", "upper", etc., may be used herein to describe the spatial position relationships of a device or a feature with other devices or features shown in the drawings. It should be understood that the terms of spatial relations are intended to include other different orientations in use or operation in addition to the orientation of the device described in the drawings. For example, if the device in the drawings is placed upside down, the device described as "above other devices or structures" or "over other devices or structures" will be positioned as "below other devices or structures" or "under other devices or structures". Thus, the exemplary term "above" may include both "above" and "below". The device can also be positioned in other different ways (rotating 90 degrees or at other orientations), and the corresponding explanations for the description of the spatial relations will be provided herein.

What described above are preferred embodiments of the present disclosure, but not intended to limit the present disclosure. For those skilled in the art, various amendments and modifications can be made. Any modifications, equivalent substitutions and improvements made within the spirits and principles of the present disclosure are all within the scope of the present disclosure.

What is claimed is:

1. An air outlet structure comprising:

an air outlet portion body having an air outlet;

an air deflector support connected to the air outlet portion body and provided at a lower portion of the air outlet; and an air deflector rotatably provided on the air deflector support;

wherein the air deflector support comprises:

a support body connected to the air deflector, and a flowing guide portion, provided on the support body and comprising at least one of a convex portion or a concave portion.

2. The air outlet structure according to claim 1, wherein the air outlet portion body is provided with a flow guiding channel; the flow guiding channel is in communication with the air outlet; and the air deflector support is connected to a channel wall of the flow guiding channel.

3. The air outlet structure according to claim 2, wherein the flow guiding channel is a groove.

4. The air outlet structure according to claim 3, wherein a cross section of the flow guiding channel is trapezoidal, and the flow guiding channel gradually shrinks in a flow direction of an air current.

5. The air outlet structure according to claim 4, wherein a second preset included angle b is formed between two adjacent side walls of the flow guiding channel, and $15° \leq b \leq 85°$ is satisfied.

6. The air outlet structure according to claim 1, wherein the flow guiding portion is provided on a lower edge of the support body.

7. The air outlet structure according to claim 6, wherein there are a plurality of flow guiding portions, and the plurality of flow guiding portions are provided at intervals along an outer edge of the support body.

8. The air outlet structure according to claim 1: wherein the flow guiding portion is a groove, and a cross-section of the groove is trapezoidal.

9. The air outlet structure according to claim 8, wherein the flow guiding portion comprises a bottom wall, a first side wall, and a second side wall; the bottom wall is disposed between the first side wall and the second side wall; and a first curved transition is formed between the bottom wall and the first side wall, and a second curved transition is formed between the bottom wall and the second side wall; or a first curved transition is formed between the bottom wall and the first side wall, or a second curved transition is formed between the bottom wall and the second side wall.

10. The air outlet structure according to claim 9, wherein a first preset included angle $\alpha$ is formed between a plane where the bottom wall is located and a horizontal plane, and the first preset included angle $\alpha$ is an acute angle.

11. The air outlet structure according to claim 10, wherein $0 \leq a \leq 15.5°$.

12. The air outlet structure according to claim 1, wherein the support body comprises:

a first outer edge, and a second outer edge joined to the first outer edge;

in a flow direction of an air current, the air current passes through the first outer edge and the second outer edge in sequence; and at least a part of the second outer edge is provided with the flow guiding portion.

13. The air outlet structure according to claim 12, wherein the support body further comprises a third outer edge connected to the second outer edge;

the second outer edge is located between the first outer edge and the third outer edge; and the third outer edge is provided with the flow guiding portion.

14. The air outlet structure according to claim 13, wherein the third outer edge is inclined downwards relative to the first outer edge.

15. The air outlet structure according to claim 1, wherein the air outlet portion body comprises a bottom shell and a panel body; and the air deflector support is provided on the panel body or on the bottom shell.

16. The air outlet structure according to claim 1, wherein the air outlet structure further comprises:

an upper air deflector support connected to the air outlet portion body and provided on an upper portion of the air outlet, and an upper air deflector rotatably provided on the upper air deflector support.

17. The air outlet structure according to claim 16, wherein the air deflector has a first position and a second position, and the upper air deflector has a third position and a fourth position;

when the air deflector is located at the first position, and when the upper air deflector is located at the third position, the air deflector and the upper air deflector are configured to block the air outlet; and when the air deflector is located at the second position, and when the upper air deflector is located at the fourth position, the air deflector and the upper air deflector are configured enable the air outlet to be exposed.

18. The air outlet structure according to claim 17, wherein the air deflector is configured to move from the first position to the second position in a first direction;

the upper air deflector is configured to move from the third position to the fourth position in a second direction; and the first direction is a clockwise direction, and the second direction is a counterclockwise direction; or the first direction is a counterclockwise direction, and the second direction is a clockwise direction.

19. An air conditioner comprising an air outlet structure, wherein the air outlet structure is the air outlet structure according to claim 1.

* * * * *